US005802903A

United States Patent [19]

Nakajima

[11] Patent Number: 5,802,903

[45] Date of Patent: Sep. 8, 1998

[54] MANUFACTURING METHOD FOR ANGLED STEEL PIPES

[75] Inventor: Norio Nakajima, Fukuroi, Japan

[73] Assignee: Nakajima Steel Pipe Co., Ltd, Osaka, Japan

[21] Appl. No.: 790,330

[22] Filed: Jan. 28, 1997

[51] Int. Cl.[6] ..... B21D 13/10; B21D 39/02; B21D 27/06

[52] U.S. Cl. ..... 72/224; 72/52; 72/200

[58] Field of Search ..... 72/51, 52, 224, 72/225, 200, 202, 367.1, 368, 176, 178, 179, 181

[56] References Cited

FOREIGN PATENT DOCUMENTS

| | | | |
|---|---|---|---|
| 59-24521 | 2/1984 | Japan | 72/52 |
| 3-216212 | 9/1991 | Japan | 72/52 |
| 6154849 | 6/1994 | Japan . | |
| 7088545 | 4/1995 | Japan . | |
| 8294722 | 12/1996 | Japan . | |

*Primary Examiner*—Joseph J. Hail, III
*Assistant Examiner*—Rodney Butler
*Attorney, Agent, or Firm*—Barnes, Kisselle, Raisch, Choate, Whittemore & Hulbert PC

[57] ABSTRACT

According to the present invention, angled steel pipes manufactured by cold forming can be manufactured into such angled steel pipes that are soft and highly stretchable over the entire sections thereof, almost free from residual stresses, and have high buckling strength, excellent secondary weldability and sufficient toughness by way of hot draw forming the pipes with an angled steel pipe forming mill.

4 Claims, 17 Drawing Sheets

MANUFACTURING METHOD FOR ANGLED STEEL PIPES

FIELD OF THE INVENTION

The present invention relates to a method for manufacturing large angled steel pipes having square and rectangular shapes which are to be used, for example, as post members for buildings or the like.

BACKGROUND OF THE INVENTION

Large angled steel pipes which are to be used as post members, etc. for buildings have conventionally been manufactured by the method disclosed, for example, by Japanese Patent Publication No. 58-13245. According to this method, a large angled steel pipe is obtained by conveying a thick steel plate in a longitudinal direction, performing edge preparation for both sides, bending portions corresponding to four corners of the angled steel pipe, with a press, so that the steel plate has a form of a quasi angled steel pipe, sequentially performing tack welding of beveled butt surfaces while passing the quasi angled steel pipe through a plurality of forming rolls for forming it into the form of the angled steel pipe, automatically welding inside and outside surfaces of the beveled members and correcting deformation.

In the large angled steel pipe manufactured through the cold forming process described above, the angle portions and seam-welded portion have hardness values pretty higher than that of the flat plate portions (base material) as seen from FIG. 14 showing a graph which visualizes hardness distribution on an inside surface and FIG. 15 showing a graph illustrating a hardness distribution on an outside surface. Therefore, angle portions and seam-welded portions have enhanced yield strengths or lowered ductilities, whereby the angled steel pipe requires special management since it may be cracked at a stage of secondary welding, etc. and residual stress produced due to ununiform mechanical properties makes it not easy to cut the angled steel pipe.

Judging from a fact that all of the angle portions, seam-welded portion and the flat plate portions have no yield point as seen, for example, from FIG. 16 comparing tensile stress-elongation curves, the conventional large angled steel pipe produces a fear, in a case of a building in which local stress distributions are often produced, that it lowers a local elongating capability of the building when a maximum yield ratio exceeds 80%.

Furthermore, the conventional large angled steel pipe has a low buckling strength since it allows tensile and compressive stresses close to a yield point to remain in the angle portions and seam-welded portion in particular. Accordingly, the conventional angled steel pipe may be cracked or uncontrollably deformed when these residual stresses are released at a stage of welding, cutting or plating with molten zinc.

In addition, the conventional large angled steel pipe allows a remarkable plastic strain to remain in the angle portions in particular after bending works as seen from a transition curve shown in FIG. 17, whereby the residual strain may remarkably embrittle the angle portions, enhance their transition temperature far higher than normal temperature and cause brittle fracture of these portions in a low temperature region.

DISCLOSURE OF THE INVENTION

The object of the present invention is to provide a method for manufacturing angled steel pipes which are uniform, soft, highly stretchable, almost free from residual stress and sufficiently tough over the entire ranges of sections thereof, which method is of a hot forming type but capable of reducing a number of press forming steps even in hot forming mode, making an end bending machine unnecessary, enhancing yield and reasonably obtaining a predetermined radius of curvature (R) on angle portions (corners).

For attaining the object, the method for manufacturing angled steel pipes according to the present invention comprises the steps of press forming flat plate material into the shape of a polygonal hollow steel pipe by a press machine; seam welding a pair of bevels of the polygonal hollow steel pipe to form the polygonal hollow steel pipe to a larger width size than that of a final product; heating an entire portion of the seam-welded polygonal hollow steel pipe in a hot oven; and then hot forming the polygonal hollow steel pipe into an angled steel pipe while drawing the polygonal steel pipe to reduce the width size thereof by an angled steel pipe forming mill.

According to the above steps of the present invention, the number of forming steps (the number of pressing operations) can be reduced to only that required for obtaining the polygonal hollow steel pipe, whereby the pressing operations can be performed speedily (in a short time) and at a low cost. Further, the present invention permits reducing equipment costs and saving labor since it eliminates the necessity to use an end bending machine and requires no end bending stage, thereby simplifying the configuration of a manufacturing line. Furthermore an angled steel pipe which is sufficiently formed so as to have predetermined sizes over the entire range from a leading end to a rear end can be manufactured by hot forming with the angled steel pipe forming mill, while drawing the polygonal hollow steel pipe. Accordingly yield can be enhanced since it is unnecessary to cut off the leading end and the rear end, or it is sufficient to cut off the ends just for a short length at a subsequent stage.

In a first preferable embodiment of the present invention, a polygonal hollow steel pipe is formed so as to have such a width size and a radius of curvature on angle portions that are respectively larger than those of a final product, then entirely heated in a hot oven and hot formed while reducing the width size and the radius of curvature with an angled steel pipe forming mill.

According to this first embodiment in which the angle portions are formed so as to have the radius of curvature on the angle portions which is larger than that on the angle portions of the final product, a flat plate material can be reasonably press formed. By hot forming the polygonal hollow steel pipe in which an original material property (molecular arrangement) is resumed by heating to a high temperature so as to reduce the width size and the radius of curvature, it is possible to obtain, without denaturalizing the plate material, a final product having a high modulus of section, i.e., an angled steel pipe having a radius of curvature on the angle portions and a width which are reasonably adjusted to predetermined sizes.

A second preferable embodiment of the present invention is characterized in that a polygonal hollow steel pipe having a width size larger than that of a final product is formed by cold forming a circular original pipe with an angled steel pipe forming mill, then entirely heated in a hot oven and formed into an angled steel pipe by hot forming with a separate angled steel pipe forming mill while reducing the width size.

According to this second embodiment in which the polygonal hollow steel pipe having the width size larger than that of the final product can be formed by cold forming the original pipe with the angled steel pipe forming mill, it is possible to manufacture an angled steel pipe which is formed in predetermined sizes from a leading end to a rear end thereof by heating the polygonal hollow steel pipe to a high temperature in a hot oven and hot forming it with the separate angled steel pipe forming mill while reducing the width size, and it is unnecessary to cut off the leading end and the rear end or it is sufficient to cut off the ends just for a short length, thereby enhancing yield.

In a third preferable embodiment of the present invention, a polygonal hollow steel pipe is formed so as to have a large width size and a large radius of curvature on angle portions, then entirely heated in a hot oven and hot formed with a separate angled steel pipe forming mill while reducing the width size and the radius of curvature on the angle portions.

According to this third embodiment wherein the angle portions are formed so as to have the radius of curvature longer than that on the angle portions of a final product, an original pipe can be cold formed reasonably and easily into a polygonal hollow steel pipe. And it is possible to obtain, with no denaturalization of the plate material, a final product having a high modulus of section, i.e., an angled steel pipe having a radius of curvature on the angle portions and a width size reasonably adjusted to predetermined sizes by hot forming, by way of reducing the width size and the radius of curvature on the angle portions of the polygonal hollow steel pipe in which the original material property (molecular arrangement) is resumed by heating to a high temperature.

DETAILED DESCRIPTION OF THE PREFERRED EMBODIMENTS

Though manufacturing methods mainly for large angled steel pipes are described as embodiments of the present invention, these methods are similarly applicable to manufacturing of small and medium angled steel pipes.

Figure 1:
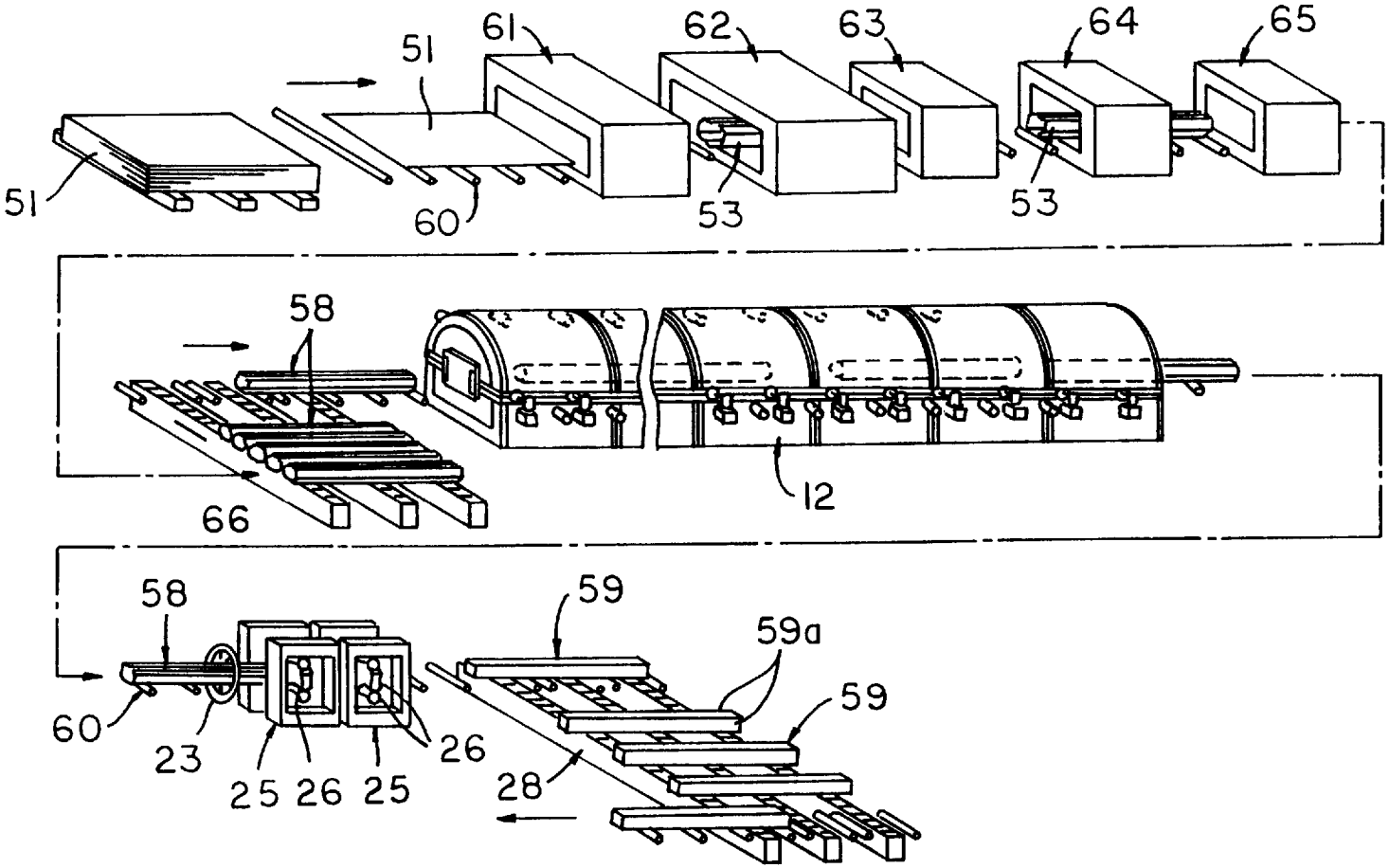
FIG. 1 is a perspective view illustrating the manufacturing method for angled steel pipes according to the first embodiment of the present invention.
Figure 2:
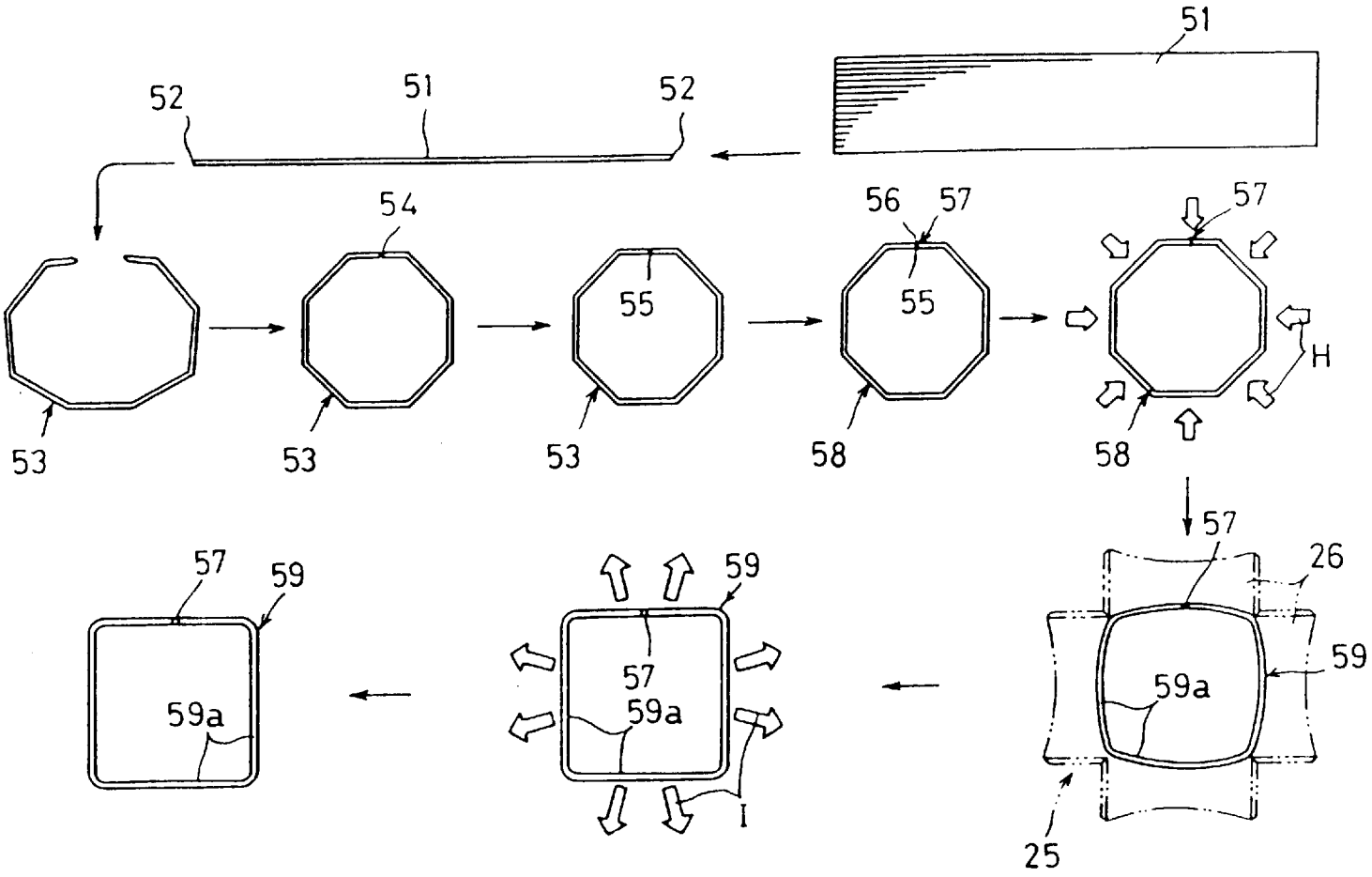
FIG. 2 is a diagram descriptive of steps of the manufacturing method for angled steel pipes according to the first embodiment of the present invention.
Figure 3:
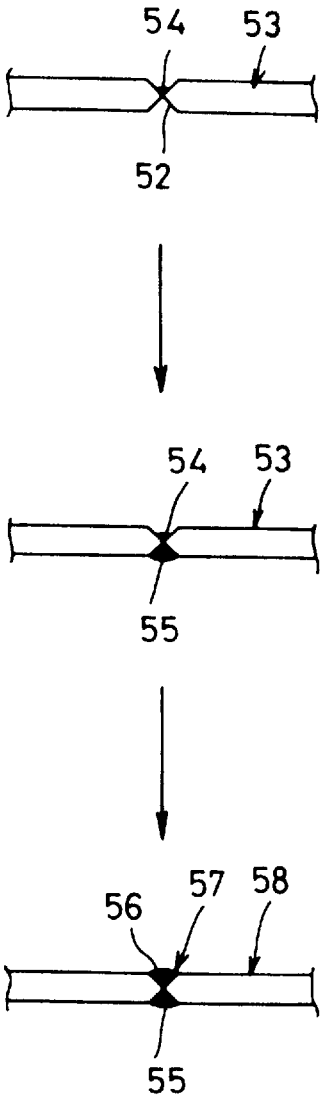
FIG. 3 is a diagram descriptive of welding steps of the manufacturing method for angled steel pipes according to the first embodiment of the present invention.

Now, the first embodiment of the present invention will be described with reference to FIGS. 1 through 3.

For manufacturing large square angled steel pipes, a large number of flat plate materials having plate thickness, length and width matched with the angled steel pipe, i.e., steel plates 51 are stored in a piled condition. Out of these steel plates 51, an uppermost steel plate 51 is lifted tip, for example, with a crane with a magnet and delivered to a conveyor 60. Then, the steel plate 51 is carried by the conveyor 60 into an edge preparation machine 61 for forming bevels 52 in a pair of edges to be seam-welded.

It is allowed to store steel plates 51 in which bevels 52 have preliminarily been formed in a piled condition, or to cut the steel plate 51 which has been coiled while uncoiling it.

The steel plates 51 in which the bevels 52 are formed are carried by the conveyor 60 into a press machine 62, which press forms the steel plates 51 into polygonal hollow steel pipes 53. Speaking concretely, an octagonal hollow steel pipe 53 having a pair of bevels 52 rather wide open is obtained, for example, by press forming seven portions thereof. At this stage, the polygonal hollow steel pipe 53 is press formed so that a seam-welded portion is always located around a center of a flat plate portion of a final angled steel pipe.

The polygonal hollow steel pipes 53 are carried by the conveyor 60 into a tack welding machine 63 and, after the bevels 52 are brought into contact with each other by applying an external pressure, tack welding 54 is carried out. Then, the polygonal hollow steel pipes 53 are carried by the conveyor 60 into an inside surface welding machine 64 for carrying out inside surface welding 55. Subsequently, the polygonal hollow steel pipes 53 are carried into an outside surface welding machine 65 and outside surface welding 56 is carried out, thereby manufacturing regular octagonal hollow steel pipes 58 having seam-welded portions 57. Each of the welding machines carries out high frequency welding or arc welding.

The polygonal hollow steel pipes 58 thus manufactured are carried from the conveyor 60 onto an inlet bed 66. When reaching a final end of the inlet bed 66, the polygonal hollow steel pipes 58 are carried into a hot oven 12 and heated to a high temperature H higher than a transformation point $A_3$ during carriage through the hot oven 12. After being heated to the predetermined temperature, the polygonal hollow steel pipes 58 are carried out of the hot oven 12 and sent into an angled steel pipe forming mill 25.

The angled steel pipe forming mill 25 performs final hot forming with a plurality of hourglass rolls 26 for transforming each angle portion of the polygonal hollow steel pipes 58 into planar surfaces and forming new angle portions on flat plate portions, thereby hot forming large square angled steel pipes 59.

Around the angled steel pipe forming mill 25, a required number of descalers 23 are disposed at required locations (that is, before and after, only before or only after the angled steel pipe forming mill 25, or between stands). The descalers 23 which remove mill scales by projecting hydraulic water to polygonal hollow steel pipes 58 are capable of improving surface skins.

Though the flat plate portions 59*a* are formed as surfaces swollen outward along drum surfaces immediately after hot forming of the angled steel pipes 59, the flat plate portions 59*a* are subsequently contracted so as to have planar surfaces and the angle portions having shorter radius of curvature R or a larger modulus of section as the angled steel pipes 59 are cooled. Since the polygonal hollow steel pipes 58 have a regular octagonal shape, the conveyor 60 can carry them while keeping them in a definite direction by utilizing the flat plate portions, whereby they can be hot formed in the angled steel pipe forming mill 25 with seam-welded portions 57 always located in a definite direction or so that the seam-welded portions 57 will be located always in the vicinities of the centers of the flat plate portions 59*a*. On the cooling bed 28, the angled steel pipes 59 are cooled with air at heat dissipation I, or gradually.

Figure 4:
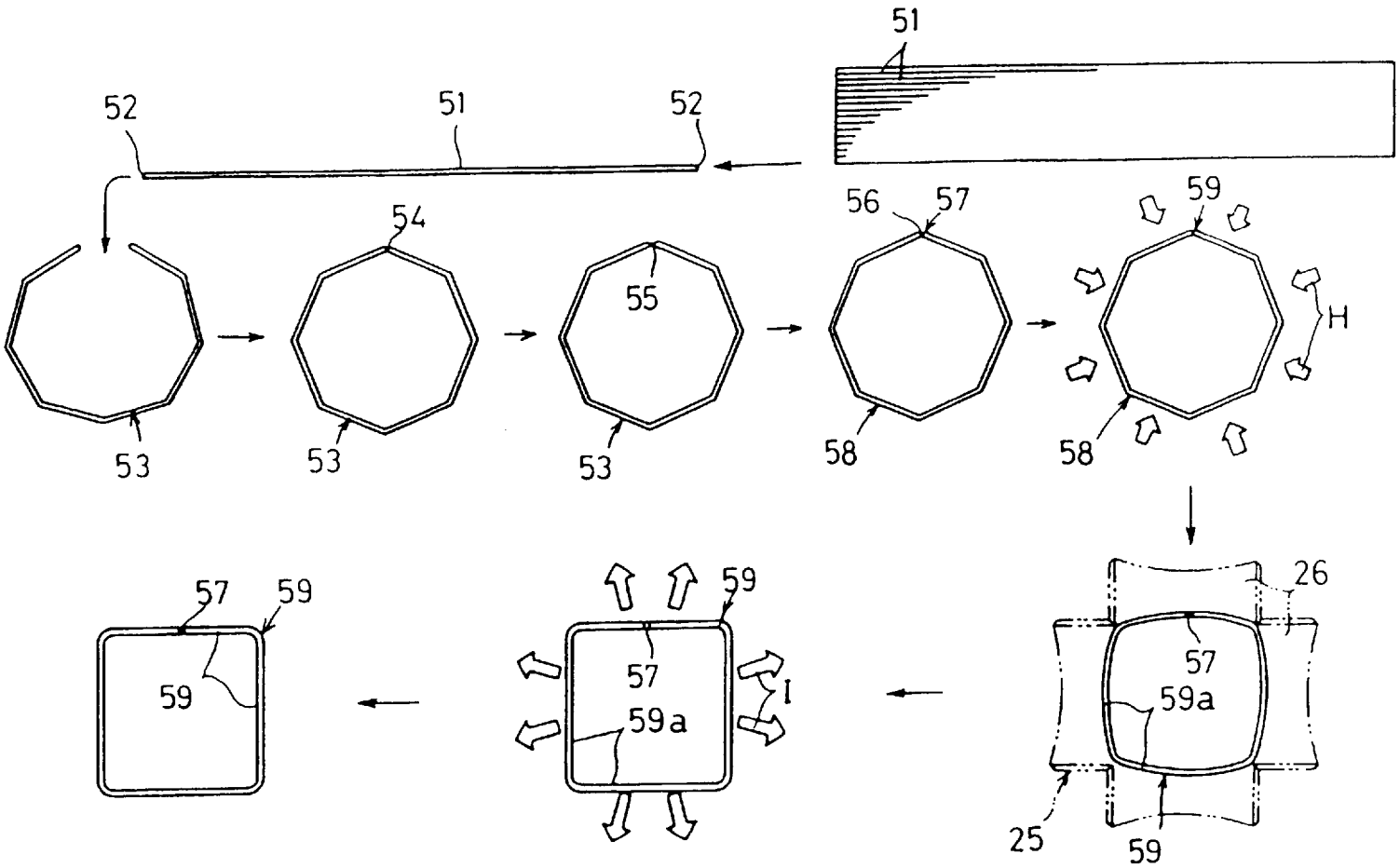
FIG. 4 is a diagram descriptive of steps of the manufacturing method for angled steel pipes according to the second embodiment of the present invention.
Figure 5:
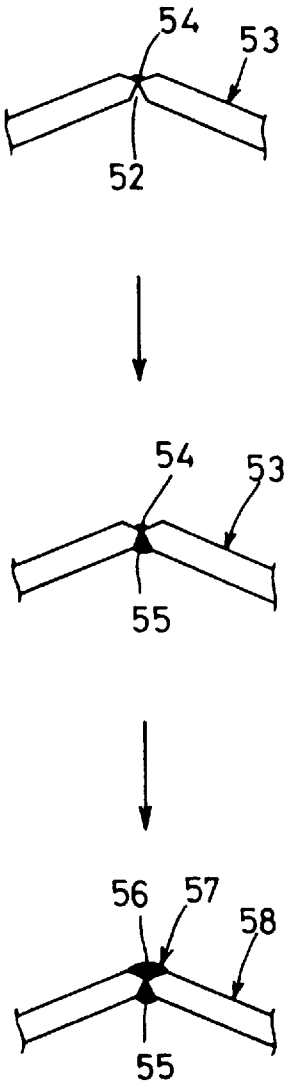
FIG. 5 is a diagram descriptive of welding steps of the manufacturing method for angled steel pipes according to the second embodiment of the present invention.

Now, description will be made of the second embodiment, which is a modification of the first embodiment, with reference to FIGS. 4 and 5.

A pressing machine 62 performs press forming of a polygonal hollow steel pipe 53 so that a seam-welded portion 57 is located at a corner of the polygonal hollow steel pipe 53. Before the polygonal hollow steel pipe 58 is carried into the angled steel pipe forming mill 25, its direction is controlled or restricted, for example, with a welded seam position adjuster (not shown) so that the seam-welded portion 57 is located always in the vicinity of a center of a flat plate portion 59*a* of a final angled steel pipe 59.

Though the angled steel pipes 59 having square sections are manufactured in the first and second embodiments described above, angled steel pipes 59 which have rectangular sections can be manufactured in the similar way. Further, pentagonal and hexagonal steel pipes 59 can be hot formed when roller arrangement is modified in the angled steel pipe forming mill 25.

Though the octagonal hollow steel pipe 53 is formed by pressing seven portions in the first and second embodiments described above, the form of the polygonal hollow steel pipe 53, or the form of the polygonal hollow steel pipe 58, is optionally adjustable into a tetragonal form, a hexagonal form, a decagonal form, etc. by changing the number of pressed portions.

The larger the number of pressed portions are, bending angles are obtuser and the polygonal hollow steel pipe 53 has a shape closer to a circle, whereby the angled steel pipe 59 can be formed more preferably. Even when the polygonal hollow steel pipe is formed by pressing a large number of portions thereof, the number is far smaller than the number of pressing steps required for the conventional round pipe.

Figure 6:
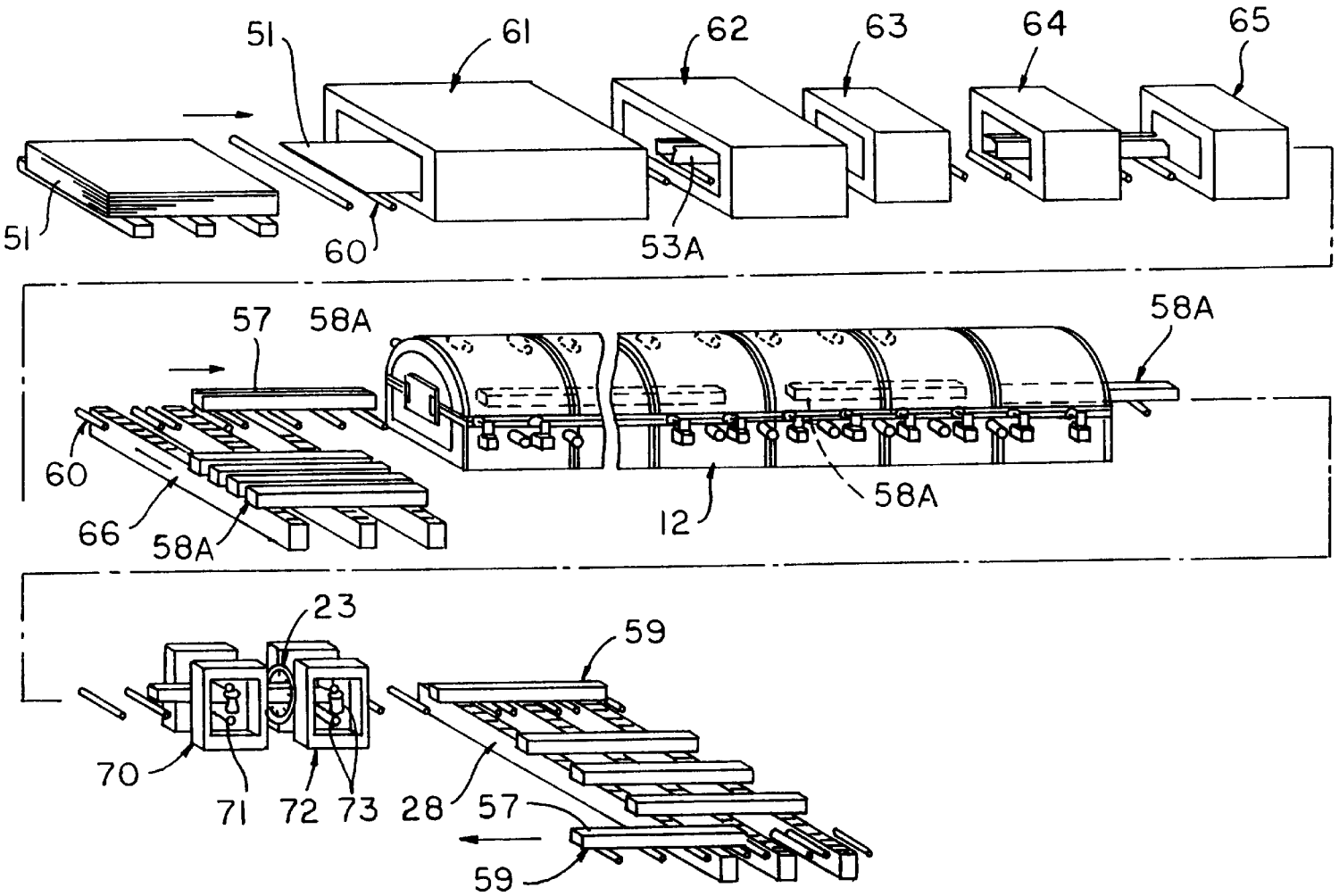
FIG. 6 is a perspective view illustrating steps of the manufacturing method for angled steel pipes according to the third embodiment of the present invention.
Figure 7:
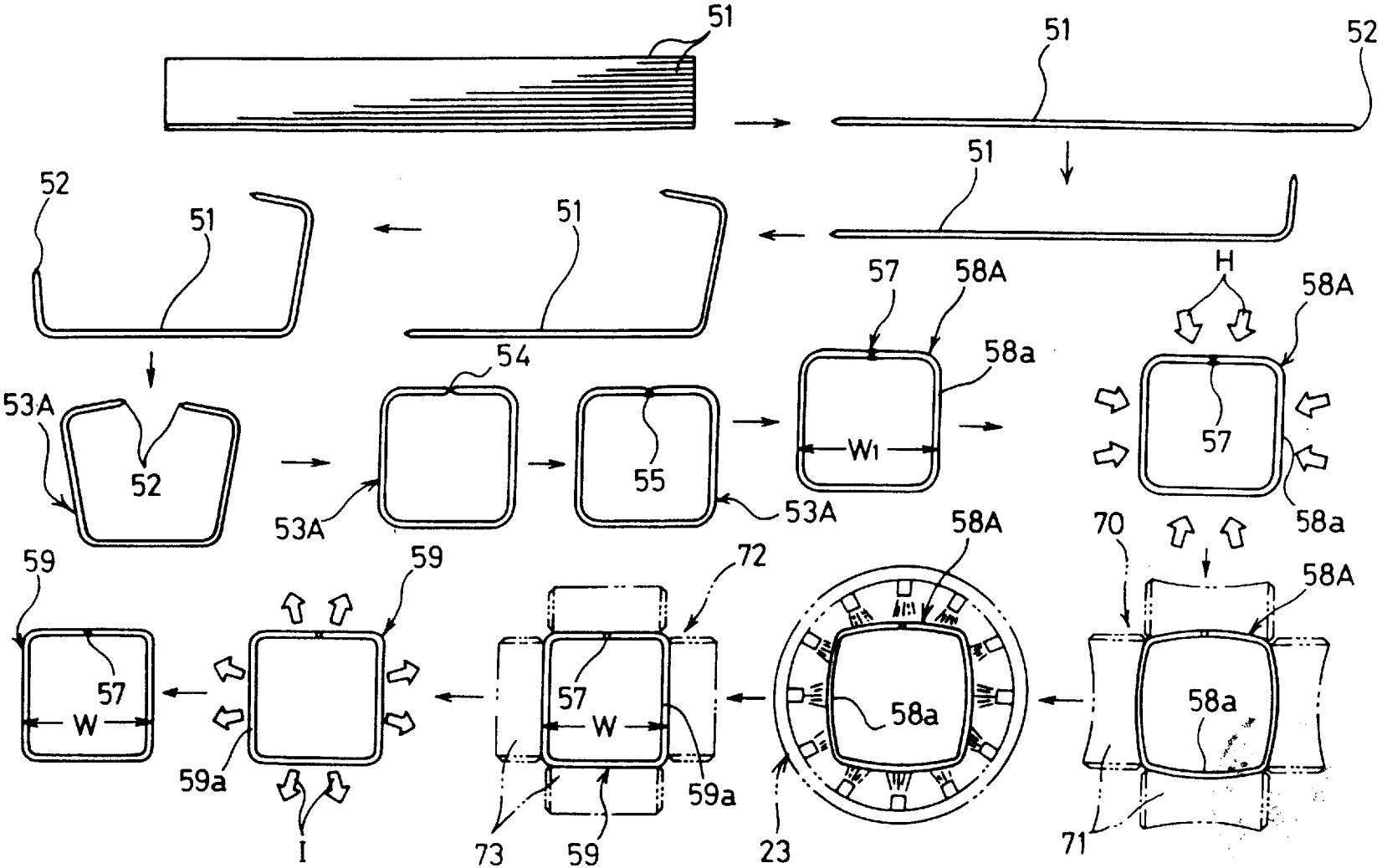
FIG. 7 is a diagram descriptive of steps of the manufacturing method for angled steel pipes according to the third embodiment of the present invention.

Now, the third embodiment of the present invention will be described with reference to FIGS. 6 and 7. Components which are represented by the reference numerals used in the first and third embodiments are the same or the substantially the same as those adopted for these embodiments, and will not be described in detail.

When large square angled steel pipes are to be manufactured, for example, flat plate materials which have predetermined thickness and length matched with the angled steel pipes (final products) and are wider than a developed shape of the angled steel pipe, i.e., steel plates 51 are stored in a condition where they are piled up in a large number.

After bevels 52 have been formed by an edge preparation machine 61, the steel plate 51 is formed into a rectangular polygonal hollow steel pipe 53A having a pair of bevels 52 open rather wide by sequentially pressing, for example, four portions with a pressing machine 62. At this stage, the polygonal hollow steel pipe 53A is pressed so that a seam-welded portion is located always in the vicinity of a center of a flat plate portion on a final angled steel pipe.

The polygonal hollow steel pipe 53A is subjected to tack welding 54 by a tack welding machine 63, inside surface welding 55 by an inside surface welding machine 64 and an outside surface welding 56 by an outside surface welding machine 65, whereby an angled polygonal hollow steel pipe 58A having a seam-welded portion 57 is manufactured.

Since the steel plate 51 is wider than the developed shape of the square angled steel pipe, each flat plate portion 58*a* of the polygonal hollow steel pipe 58A thus manufactured has width $W_1$ which is larger than a width of a flat plate portion of a final product (to be described later).

The polygonal hollow steel pipe 58A thus manufactured is carried from a conveyor 60 onto an inlet bed 66, carried into a hot oven 12 from a rear end thereof and heated to a high temperature H during carriage through the hot oven 12.

After being heated to the predetermined temperature, the polygonal hollow steel pipe 58A is carried out of the hot oven 12 and sent into a pre-stage angled steel pipe forming mill 70. The pre-stage angled steel pipe forming mill 70 which performs hot forming (forming temperature higher than a transformation point $A_3$) with a plurality of hourglass type rolls 71 carries out drawing of the polygonal hollow steel pipe 58A as a pre-stage. Then, the polygonal hollow steel pipe 58A is carried into a post-stage angled steel pipe forming mill 72. The post-stage angled steel pipe forming mill 72 which performs hot forming (forming temperature higher than a transformation point $A_3$) with a plurality of flat rolls 73 carries out drawing of the polygonal hollow steel pipe 58A as a post stage (final stage), whereby a large square angled steel pipe 59 having the predetermined sizes is hot formed.

The angled steel pipe 59 is a final product and has flat plate portions 59*a* having width W made narrower than the width $W_1$ of the flat plate portion 58*a* of the polygonal hollow steel pipe 58A by the drawings at the two stages (a plurality of stages), or $W<W_1$. Owing to the hot drawings, the angled steel pipe 59 is formed completely or nearly completely over the entire range from its leading end to rear end and it is unnecessary to cut off the leading end and rear end or it is sufficient to cut off the ends only for a short length at a subsequent stage, thereby enhancing yield.

Immediately after the hot forming, the angled steel pipe 59 has flat plate portions 59*a* which are planar, angle portions which have short radius of curvature R and a high modulus of section. Then, the hot formed angled steel pipe 59 is cooled with air during carriage on a cooling bed 28 at heat dissipation I, or cooled gradually.

Though the polygonal hollow steel pipe 58A is hot formed while being drawn at the two stages of the pre-stage angled steel pipe forming mill 70 and the post-stage angled steel pipe forming mill 72 in the third embodiment described above, the polygonal hollow steel pipe may be subjected to hot forming while drawing at a single stage or a plurality of stages.

Figure 8:
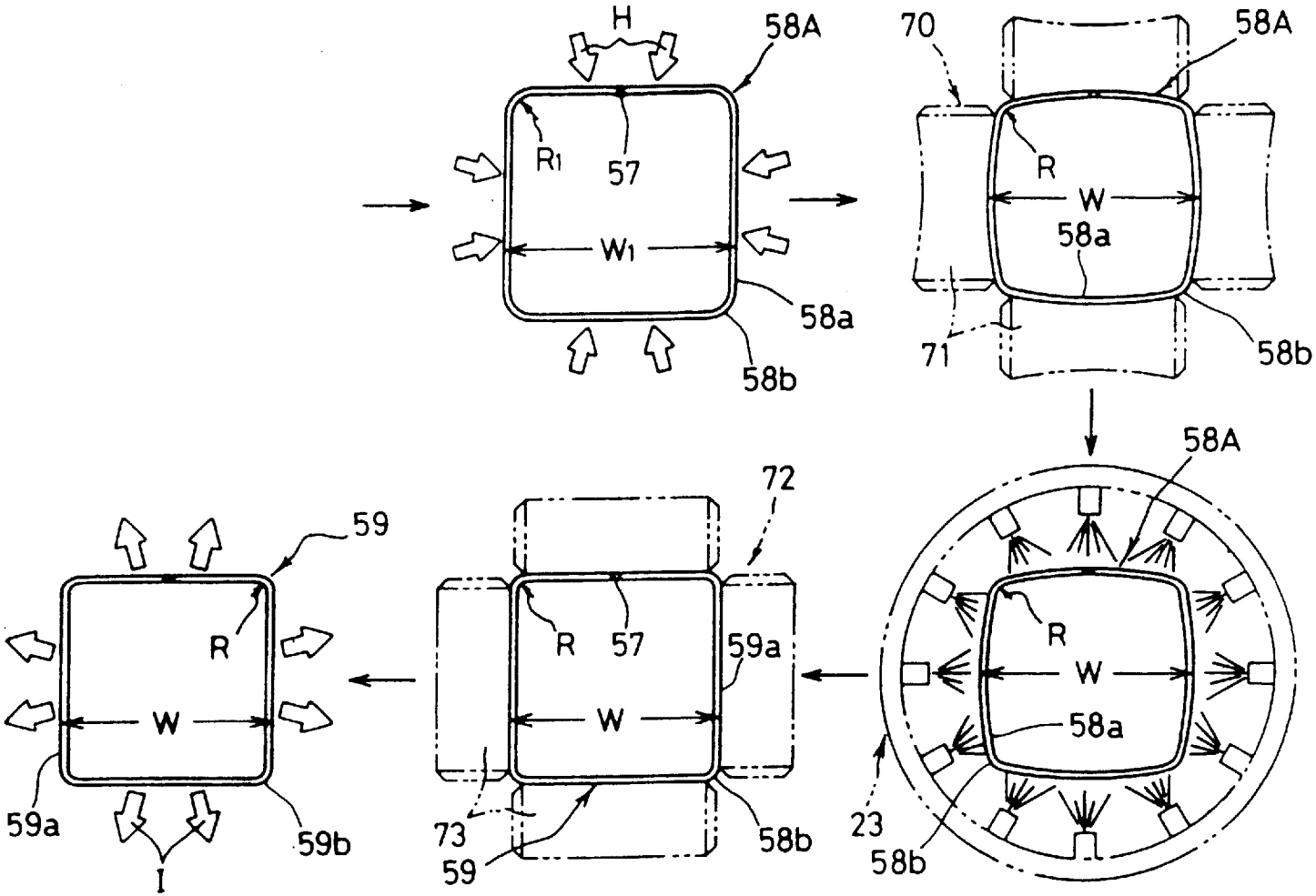
FIG. 8 is a diagram descriptive of steps of the manufacturing method for angled steel pipes according to the fourth embodiment of the present invention.

The fourth embodiment which is a modification of the third embodiment will be described with reference to FIG. 8.

A thick steel plate 51 is press molded by a pressing machine 62 into a polygonal hollow steel pipe 53A, which is subjected to tack welding 54 by a tack welding machine 63, inside surface welding 55 by an inside surface welding machine 64 and outside surface welding 56 by an outside surface welding machine 65, whereby an angled polygonal hollow steel pipe 58A having a seam-welded portion 57 is manufactured.

Since a steel plate (flat plate material) 51 which is wider than a developed shape of a square angled steel pipe (final product) is used for manufacturing the polygonal hollow steel pipe 58A by the press molding, the polygonal hollow steel pipe 58A is formed so as to have flat plate portions 58*a* each having width $W_1$ larger than a width of a flat plate portion of the final product and angle portions 58*b* each having a radius of curvature $R_1$ longer than a radius of curvature on an angle portion of the final product.

The polygonal hollow steel pipe 58A manufactured as described above is carried from a conveyor 60 onto an inlet bed 66, sent into a hot oven 12 from a rear end thereof and heated to a high temperature H during carriage through the hot oven 12.

The polygonal hollow steel pipe 58A which has been heated to the predetermined temperature is carried out of the hot oven 12 and sent into a pre-stage angled steel pipe forming mill 70. The pre-stage angled steel pipe forming mill 70 is configured for hot forming (forming temperature higher than a transformation point $A_3$) with a plurality of hourglass type rolls 71 while drawing the polygonal hollow steel pipe 58A as a pre-stage. Then, the polygonal hollow steel pipe 58A is carried into a post-stage angled steel pipe forming mill 72. The post-stage angled steel pipe forming mill 72 is configured for hot forming (forming temperature higher than a transformation point $A_3$) with a plurality of flat rolls 73 and carries out drawing formation of the polygonal hollow steel pipe 58A as a post-stage (final stage).

An angled steel pipe 59 is manufactured as a final product by carrying out the draw forming of the polygonal hollow steel pipe 58A at a plurality of stages with the pre-stage angled steel pipe forming mill 70 and the post-stage angled steel pipe forming mill 72 (or at a single stage). By the draw forming described above, the angled steel pipe 59 is formed to have the flat plate portions 59*a* having width W smaller than a width $W_1$ of the polygonal hollow steel pipe 58A, or $W<W_1$ and angle portions 59*b* having a radius of curvature R shorter than a radius of curvature $R_1$ of angle portions 58*b* of the polygonal hollow steel pipe 58A, or $R<R_1$.

Since the angle portions 58*b* has the radius of curvature $R_1$ longer than the radius of curvature R on the angle portions 59*b* of the angled steel pipe (final product) 59, they can be formed with a press reasonably and easily. Further, a final product having a high modulus of section, i.e., the angle steel pipe 59 can be obtained, with no denaturalization, by hot forming the polygonal hollow steel pipe 58A in which an original material property (molecular arrangement) is resumed so as to narrow width W and shorten the radius of curvature R on the angle portions 59*b* by heating to a high temperature H.

Though the polygonal hollow steel pipe 58A is manufactured by carrying out the outside surface welding 56 after the tack welding 54 and inside surface welding 55 are performed for the polygonal hollow steel pipe 53A in the third and fourth embodiments described above, the inside surface welding 55 may be carried out after the outside surface welding 56, the inside surface welding 55 and the outside surface welding 56 may be carried out at the same time or the tack welding 54 may be omitted.

Figure 9:
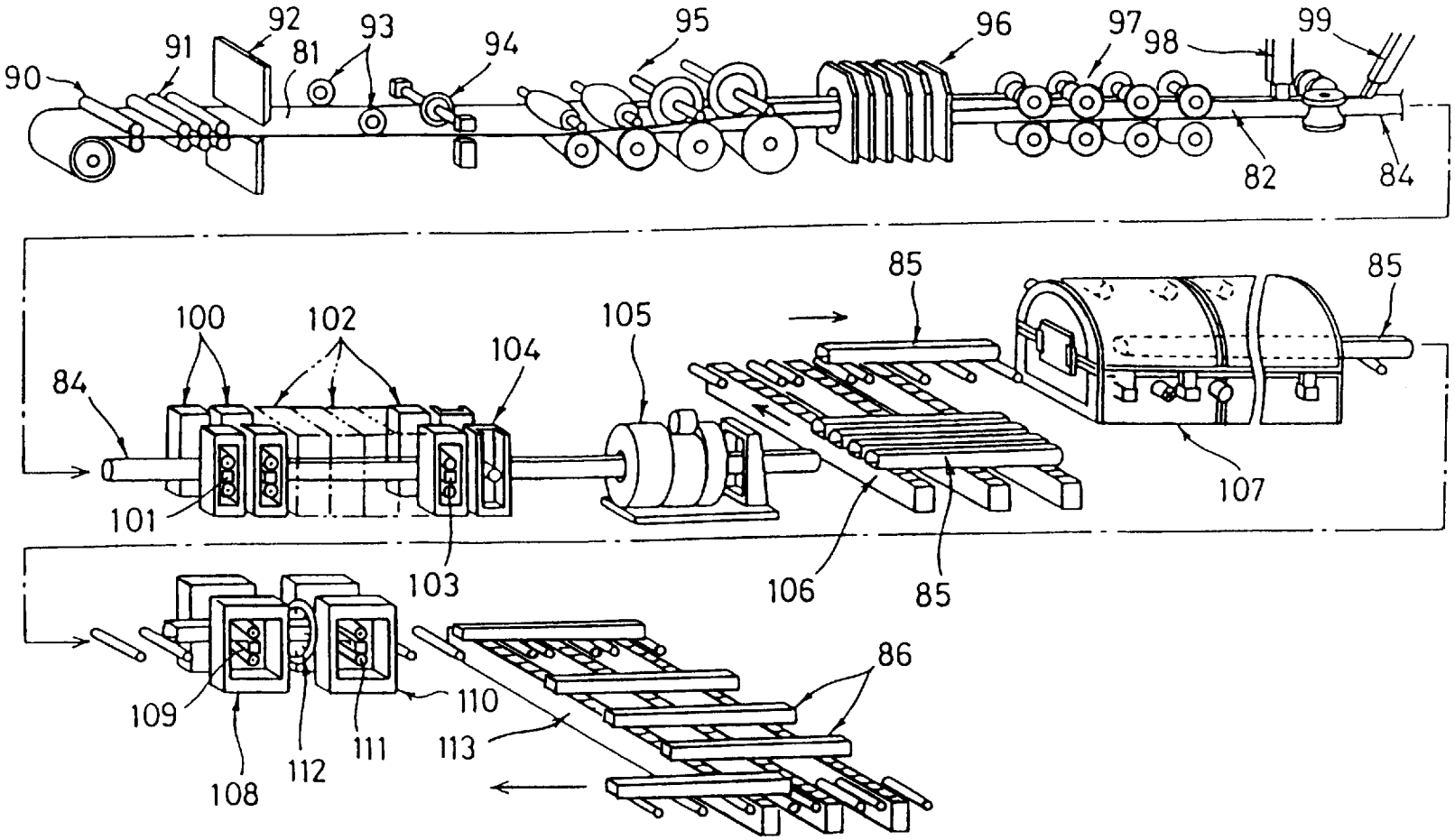
FIG. 9 is a perspective view illustrating steps of the manufacturing method for angled steel pipes according to a fifth embodiment of the present invention.
Figure 10:
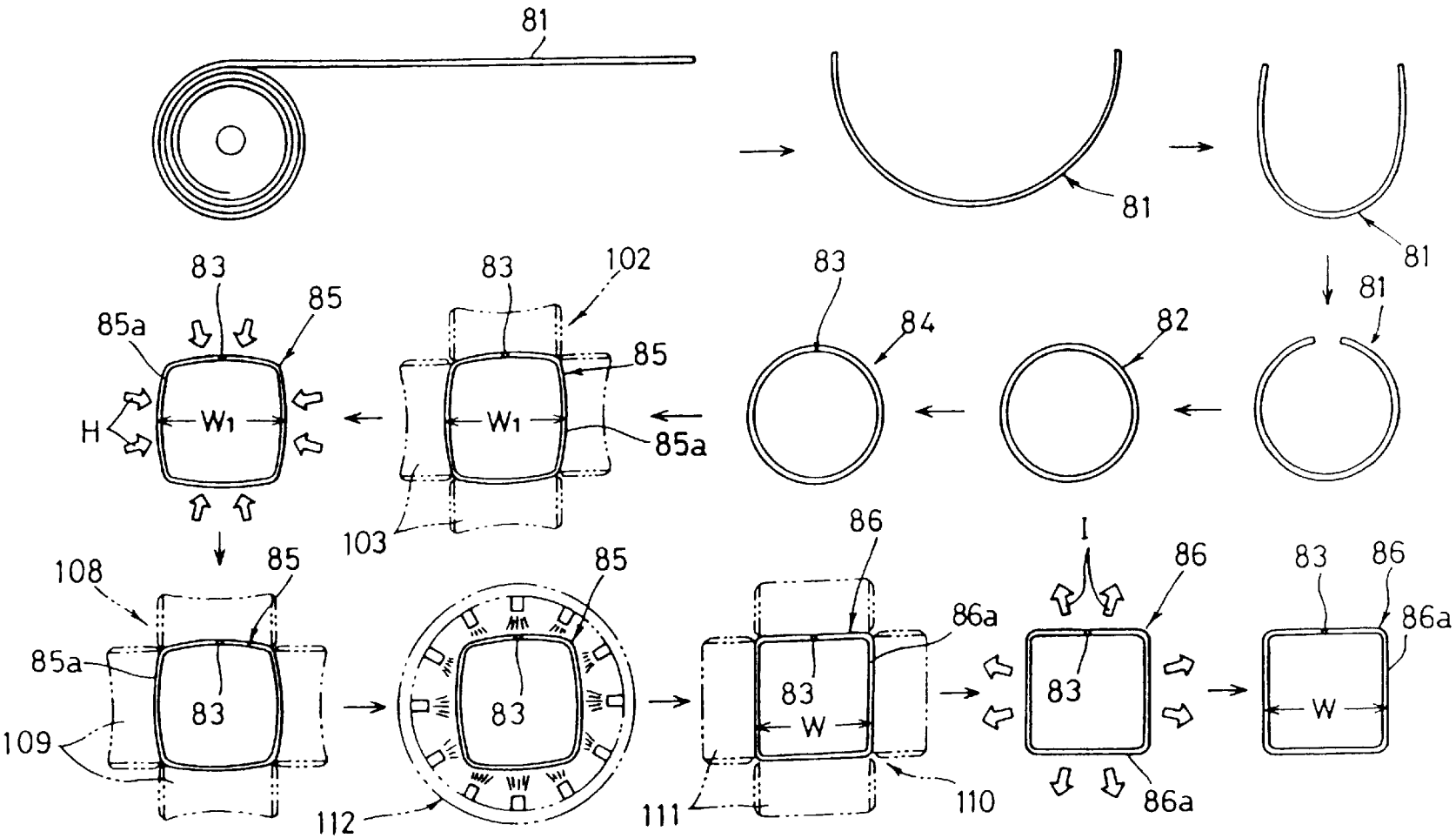
FIG. 10 is a diagram illustrating steps of the manufacturing method for angled steel pipes according to the firth embodiment of the present invention.

Now, the fifth embodiment will be described with reference to FIGS. 9 and 10.

For manufacturing a large square angled steel pipe, a material which has predetermined plate thickness and length matched with the angled steel pipe (final product), i.e., steel plate 81, is prepared in a coiled (rolled) condition. The steel plate 81 is unrolled by an unrolling apparatus 90 consisting of pinch rollers and made flat by leveling apparatus 91. Then, only an unrolled leading end of the steel plate 81 is cut and removed by a cutter 92.

From the steel plate 81 which has been unrolled as described above and is being moved continuously, both sides are cut and removed by a trimming machine 93 so that it is wider than a developed shape of the angled steel pipe (final product). After the steel plate 81 is formed by a preforming apparatus 94 so that it has a long radius of curvature R, it is gradually formed by a breakdown apparatus 95 until it has a U shape.

A pair of vertical plate portions of the U-shaped steel plate 81 are bent inward by a cluster apparatus 96. Then, the steel plate 81 is gradually formed into a cylindrical form by a fin pass apparatus 97, whereby a circular hollow steel pipe 82 having a pair of side edges which are kept in contact with each other is press formed. The circular hollow steel pipe 82 is fed into a high frequency resistance welding machine 98 for fusion welding while heating and beads are cut off from outside surfaces by a cutter 99, whereby a circular hollow steel pipe (original pipe) 84 having a seam-welded portion 83 is manufactured.

The hollow steel pipe 84 which has been manufactured as described above is fed into a plurality of (two) sizes 100 and formed (reformed) by a plurality of hourglass rolls 101 so that it has a section close to a circle. Then, the hollow steel pipe 84 is carried into an angled steel pipe forming mills (scaling machines) 102. There are disposed a plurality of (five) angled steel forming mills 102 each of which performs cold forming gradually with a plurality of hourglass rolls 103, thereby forming a polygonal hollow steel pipe 85 having a square section.

At this stage, the polygonal hollow steel pipe 85 is cold formed so that a seam-welded portion 83 is always located in the vicinity of a center of a flat plate portion on a final angled steel pipe. Since the steel plate 81 wider than the developed shape of an angled steel pipe is used, the polygonal hollow steel pipe 85 has flat plate portions 85*a* each having width $W_1$ larger than a width of a flat plate portion of a final product (to be described later). The polygonal hollow steel pipe 85 is subjected to bending correction in a bending correct (task head) 104 and cut into a predetermined length by a milling type travelling cutter 105.

The polygonal hollow steel pipe 85 thus manufactured is subsequently stored at the site or at a separate location, and carried and delivered onto a conveyor type inlet bed 106. After carried to a final end of the inlet bed 106, the polygonal hollow steel pipe 85 is sent into a hot oven 107, carried in the longitudinal direction and heated during the carriage to a high temperature H exceeding the transformation point $A_3$.

After being heated to the predetermined temperature, the polygonal hollow steel pipe 85 is carried out of the hot oven 107 and led into a pre-stage angled steel pipe forming mill 108. This pre-stage angled steel pipe forming mill 108 is configured for hot forming (forming point higher than a transformation point $A_3$) with a plurality of hourglass rolls 109 and carries out a pre-stage draw forming of the polygonal hollow steel pipe 85. Then, the polygonal hollow steel pipe 85 is carried into a post-stage angled steel pipe forming mill 110. The post-stage angled steel pipe forming mill 110 is configured for hot forming (forming temperature higher than a transformation point $A_3$) with a plurality of flat rolls 111 and carries out a post-stage (final stage) draw forming of the polygonal hollow steel pipe 85, thereby manufacturing a large square angled steel pipe 86 which has predetermined dimensions.

The angled steel pipe 86 is a final product whose flat plate portions 86*a* have a width size W made narrower by the draw forming at the two stages (a plurality of stages) than the width size $W_1$ of the flat portion 85*a* of the polygonal hollow steel pipe 85 or $W<W_1$. Since the angled steel pipe 86 is formed completely or almost completely from a leading end to a rear end by the hot draw forming, it is therefore unnecessary to cut off the leading end and the rear end or it is sufficient to cut off the ends only for a short length at a subsequent stage, thereby enhancing yield. Further, immediately after the hot forming of the angled steel pipe 86, the flat plate portions 86*a* are planar and the angle portions have a short radius of curvature R, thereby enhancing a module of section.

In the vicinity of the pre-stage and post-stage angled steel pipe forming mills 108 and 110, a descaler 112 projects hydraulic water to the angled steel pipe 86 for removing mill scales or improving skin. The hot formed angled pipe 86 is received by a cooling bed 113 and cooled with air at heat dissipation I or cooled gradually at the same atmospheric temperature so as to reduce deformation during the cooling.

Though the hollow steel pipe 84 is cold formed into the polygonal hollow steel pipe 85 with the angled steel pipe forming mill 102 at a single stage in the fifth embodiment described above, the angled steel pipe forming mill 102 may be disposed at a plurality of stages. Further, the hot draw forming of the polygonal hollow steel pipe 85 is carried out by the two pre-stage angled steel pipe forming mill 108 and the post-stage angled steel pipe forming mill 110, the hot draw forming may be carried out at a single stage or a plurality of stages.

Though the hollow steel pipe 84 is formed by welding the circular hollow steel pipe 82 which is open only on one side in the fifth embodiment described above, the hollow steel pipe 84 may be formed by attaching a pair of members which have a semicircular section (a plurality of divided arc-like members) to each other and welding these members so as to form seam-welded portions 83 at two locations (a plurality of locations).

Figure 11:
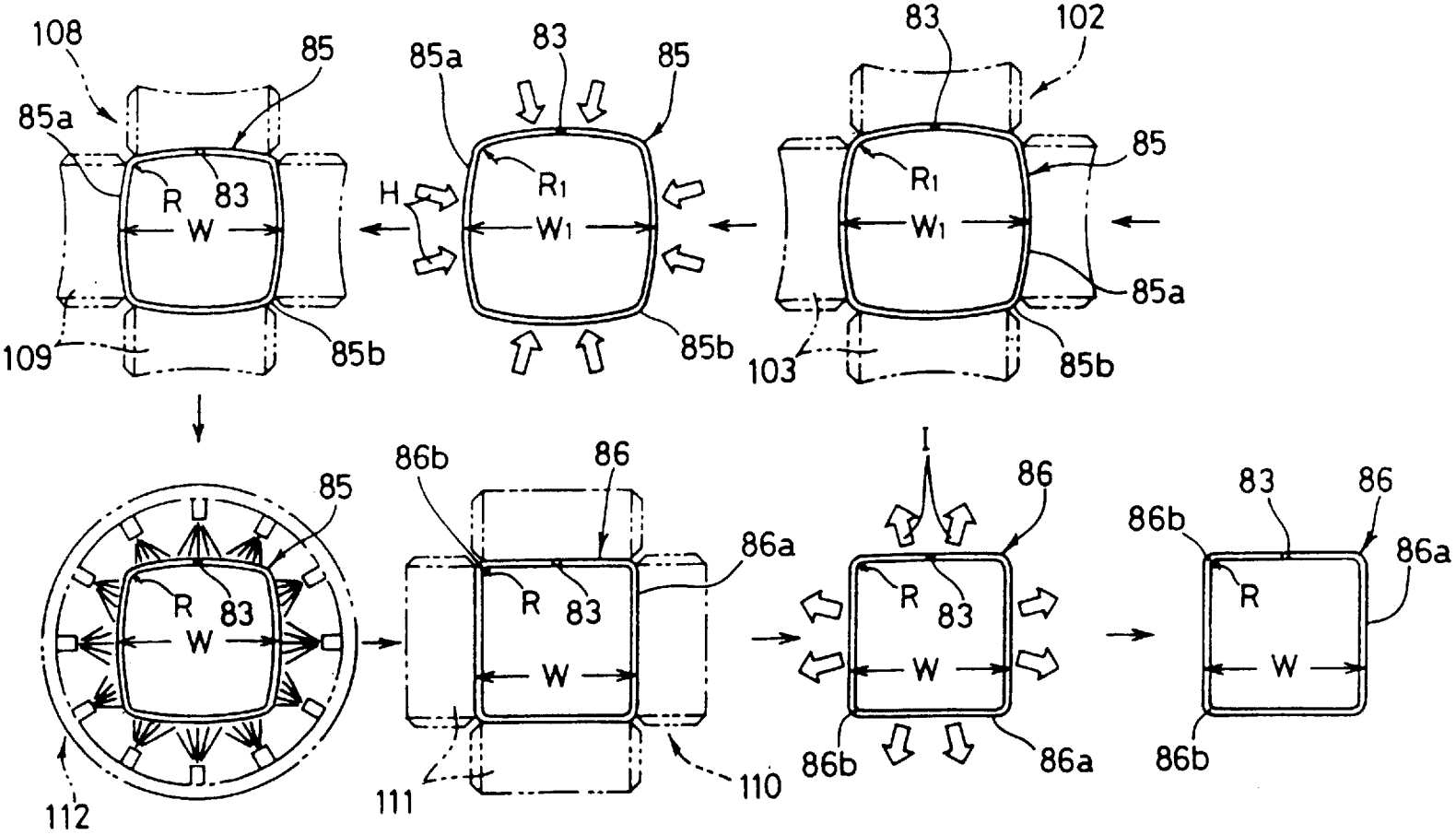
FIG. 11 is a diagram descriptive of steps of the manufacturing method for angled steel pipes according to a sixth embodiment of the present invention.

Then, the sixth embodiment which is a modification of the fifth embodiment will be described with reference to FIG. 11.

A hollow steel pipe 84 which has been formed (reformed) so as to have a nearly round section by hourglass rolls 101 in a sizer 100 is carried into an angled steel pipe forming mill 102 and gradually cold formed by a plurality of hourglass rolls 103, whereby a polygonal hollow steel pipe 85 having a square section is manufactured.

Since the polygonal hollow steel pipe 85 is manufactured from a steel plate 81 which is wider than a developed shape of the angled steel pipe at a stage where both sides are cut off with a trimming apparatus 93, the polygonal hollow steel pipe 85 has flat plate portions 85*a* having width size $W_1$ larger than a width of a flat plate portion of a final product and angle portions 85*b* having radius of curvature $R_1$ longer than a radius of curvature on an angle portion of the final product.

The polygonal hollow steel pipe 85 which has been manufactured as described above is carried in the longitudinal direction through a hot oven 107 and heated to a high temperature H during the carriage. Then, the polygonal hollow steel pipe 85 is carried into a pre-stage angled steel pipe forming mill 108, where it is subjected to hot forming (forming temperature higher than a transformation point $A_3$) by a plurality of hourglass rolls 109, or a pre-stage drawing. After mill scales, etc. have been removed with hydraulic water projected from a descaler 112, the polygonal hollow steel pipe 85 is carried into a post-stage angled steel pipe forming mill 110, where it is subjected to hot forming (forming temperature higher than a transformation point $A_3$) by a plurality of flat rolls 111, or a post-stage (final stage) drawing.

By performing the drawing of the polygonal hollow steel pipe 85 at the plurality of stages with the pre-stage angled steel pipe forming mill 108 and the post-stage angled steel pipe forming mill 110 (or drawing at a single stage), an angled steel pipe 86 is manufactured as a final product. At the drawing stages, the angled steel pipe 86 is formed so that flat plate portions 86*a* of the angled steel pipe 86 have a width size W which is smaller than the width size $W_1$ of the flat plate portions 85*a* of the polygonal hollow steel pipe 85, or $W<W_1$, and the angle portions 86*b* has radius of curvature R shorter than radius of curvature $R_1$ of the angle portions 85*b* of the polygonal hollow steel pipe 85, of $R<R_1$.

Since the angled steel forming mill 102 forms the angle portions 85*b* so that they have radius of curvature $R_1$ which is longer than the radius of curvature R of the angle portions 86*b* of the angled steel pipe (final product) 86, the hollow steel pipe 84 can be cold formed reasonably and easily into the polygonal hollow steel pipe 85. Further, it is possible to obtain a final product having a high modulus of section, i.e., the angled steel pipe 86 with no denaturalization since the polygonal hollow steel pipe 85 in which an original material property (molecular arrangement) is resumed by heating to the high temperature H is hot drawn so as to reduce the width size W and shorten the radius of curvature R on the angle portions 86*b*.

Figure 12:
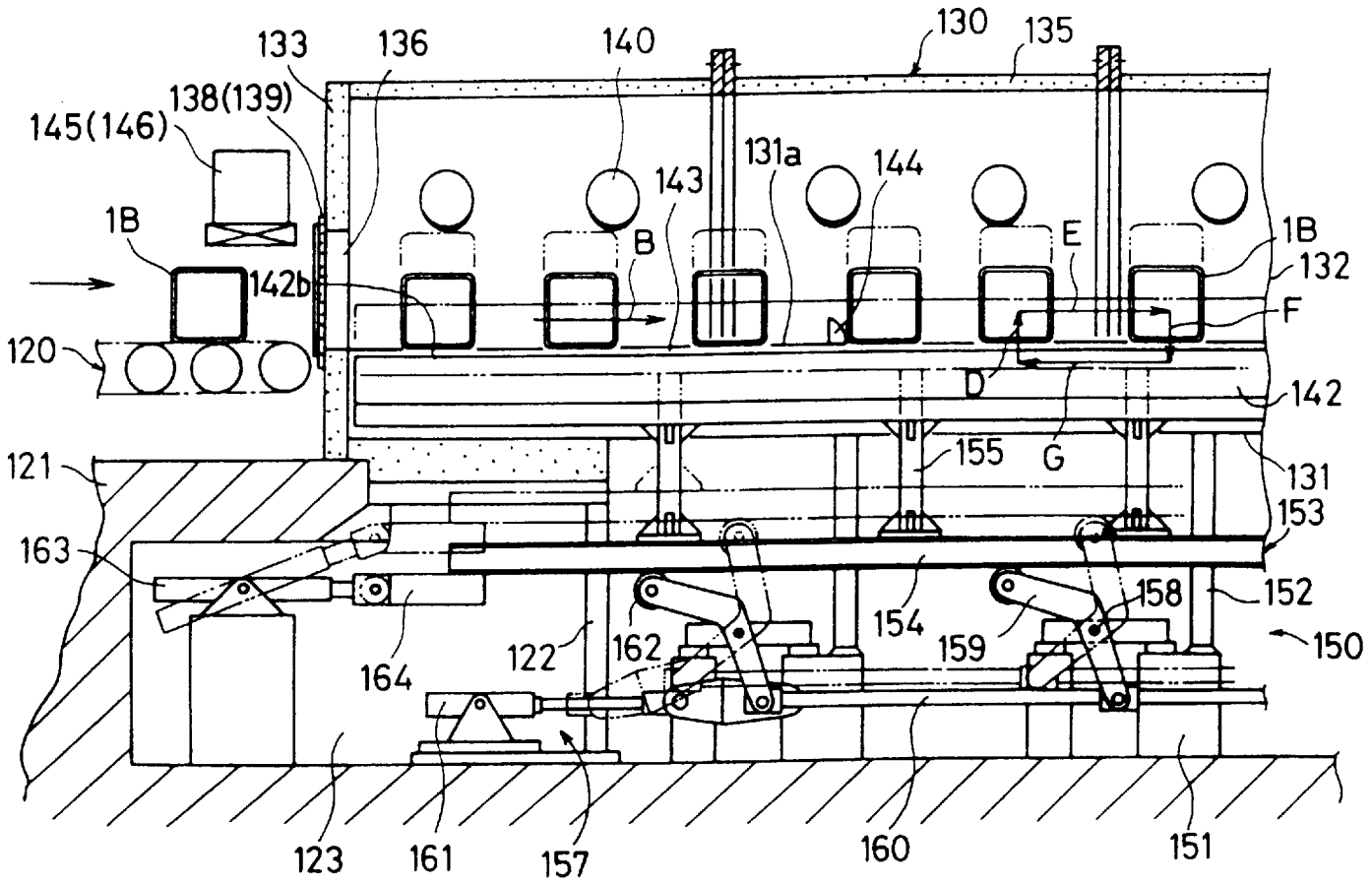
FIG. 12 is a longitudinal side sectional view illustrating a hot oven to be used by the manufacturing method for angled steel pipes according a seventh embodiment of the present invention.
Figure 13:
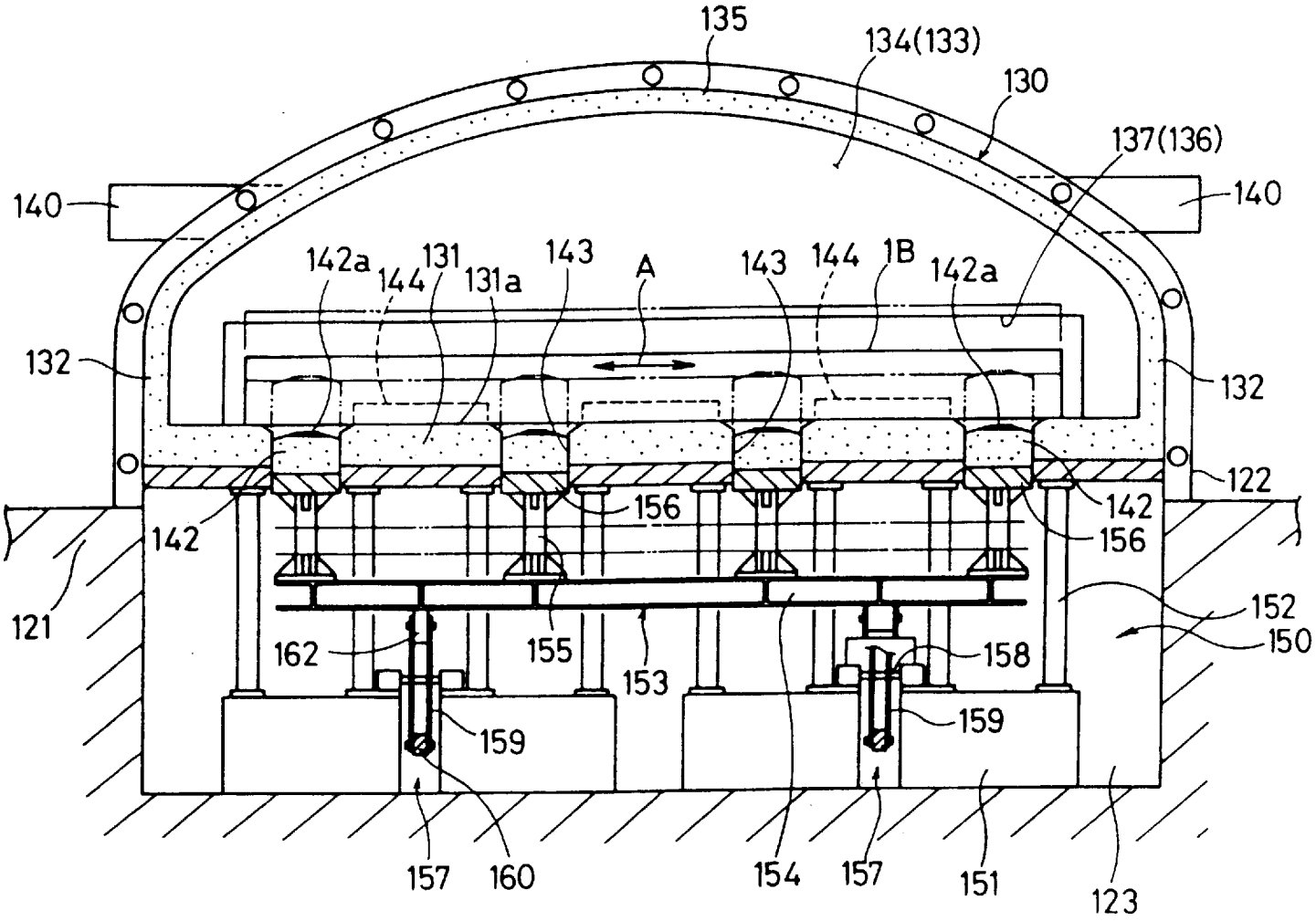
FIG. 13 is a longitudinal front sectional view illustrating the hot oven to be used in the seventh embodiment of the present invention.
Figure 14:
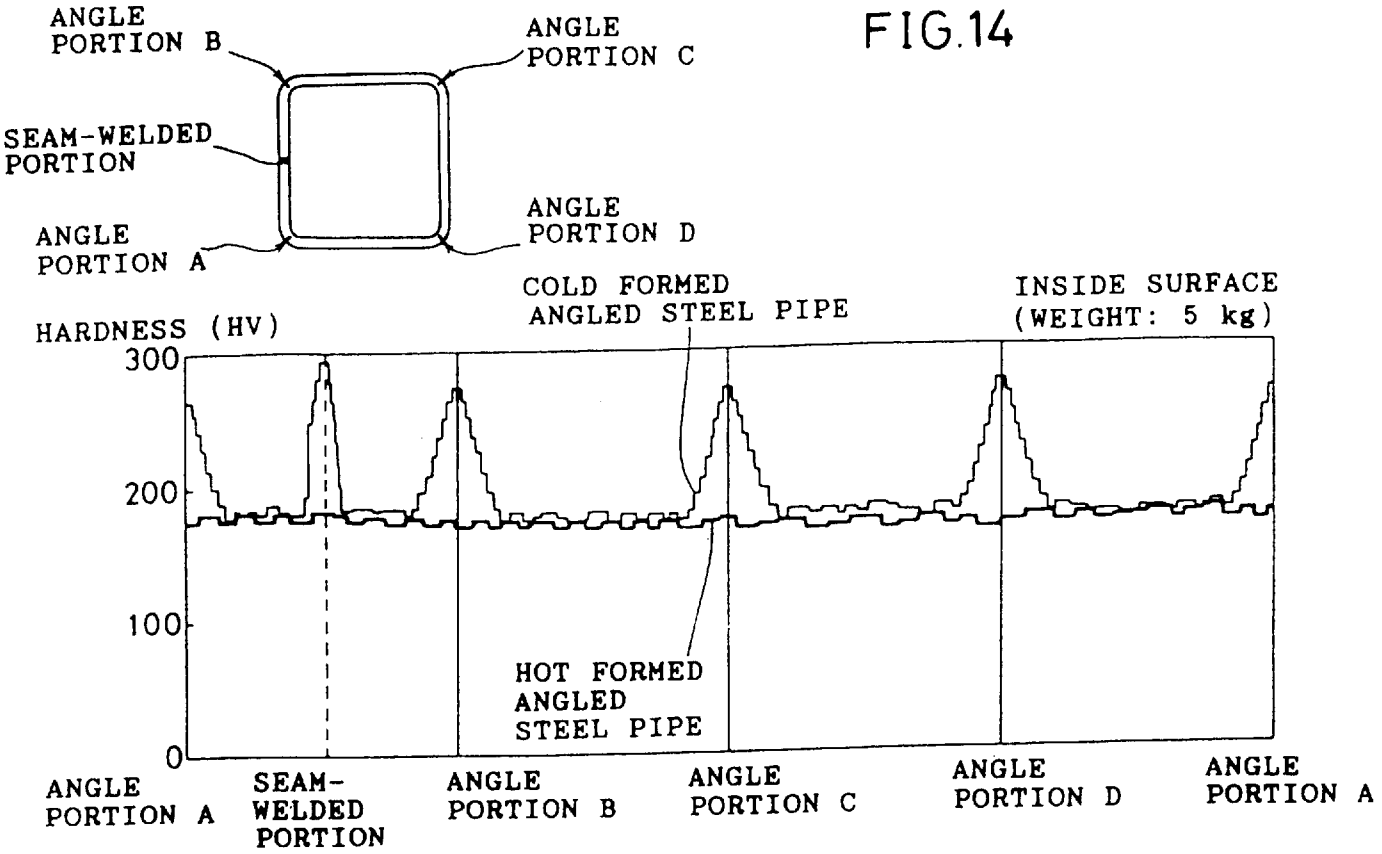
FIG. 14 shows a graph illustrating hardness distributions on inside surfaces for comparing the angled steel pipe manufactured by the method according to the present invention with a conventional angled steel pipe.
Figure 15:
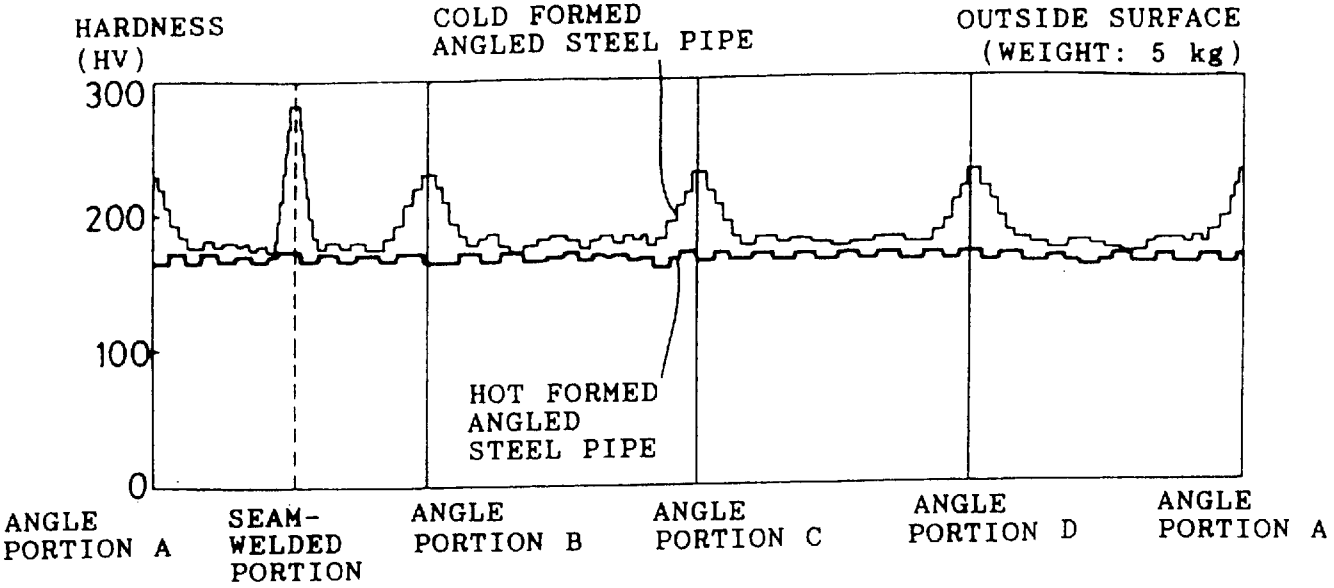
FIG. 15 shows a graph illustrating hardness distributions on outside surfaces for comparing the angled steel pipe manufactured by the method according to the present invention with the conventional angled steel pipe.
Figure 16:
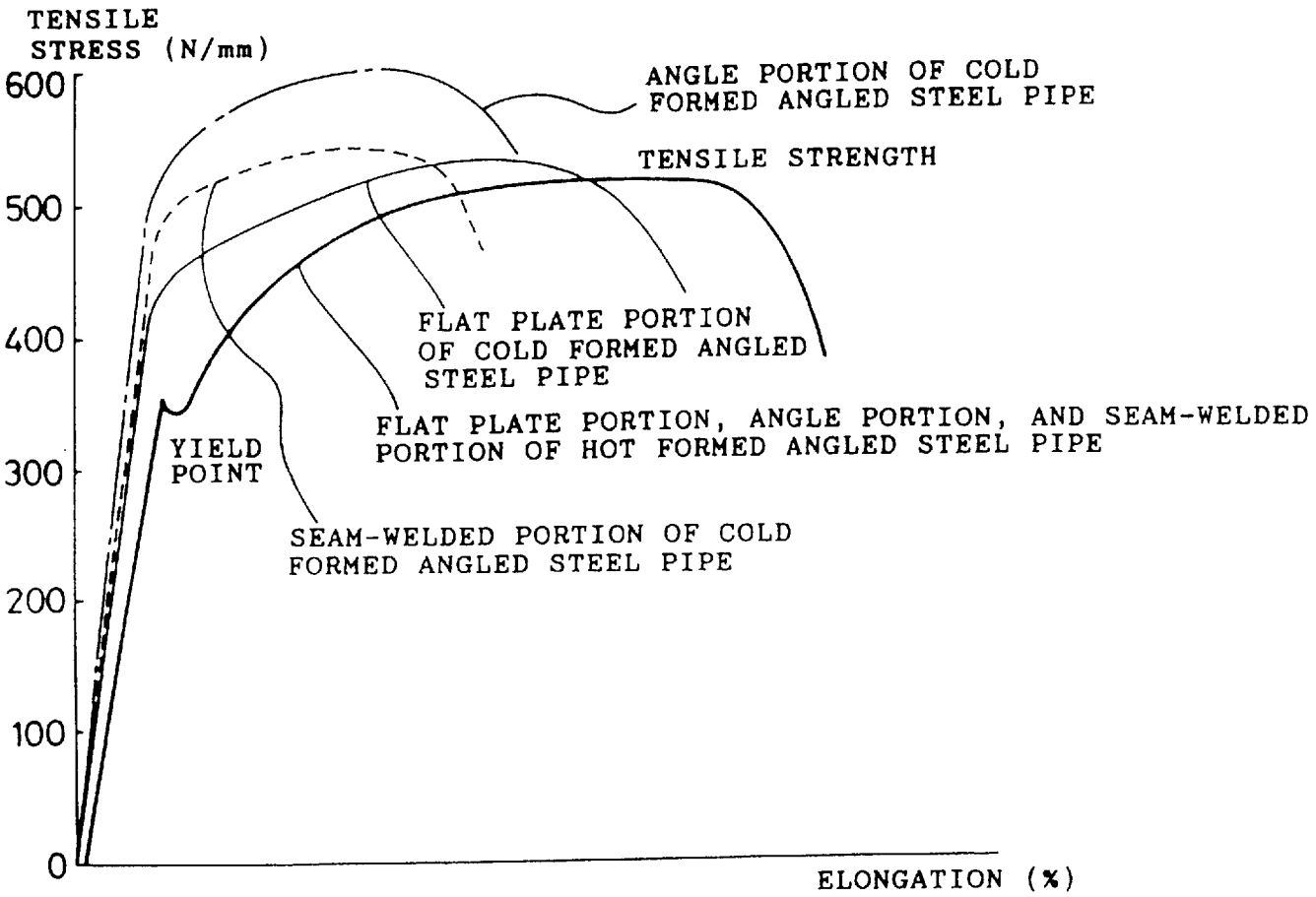
FIG. 16 shows a graph illustrating tensile strength-elongation characteristics for comparing the angled steel pipe manufactured by the method according to the present invention with the conventional angled steel pipe.
Figure 17:
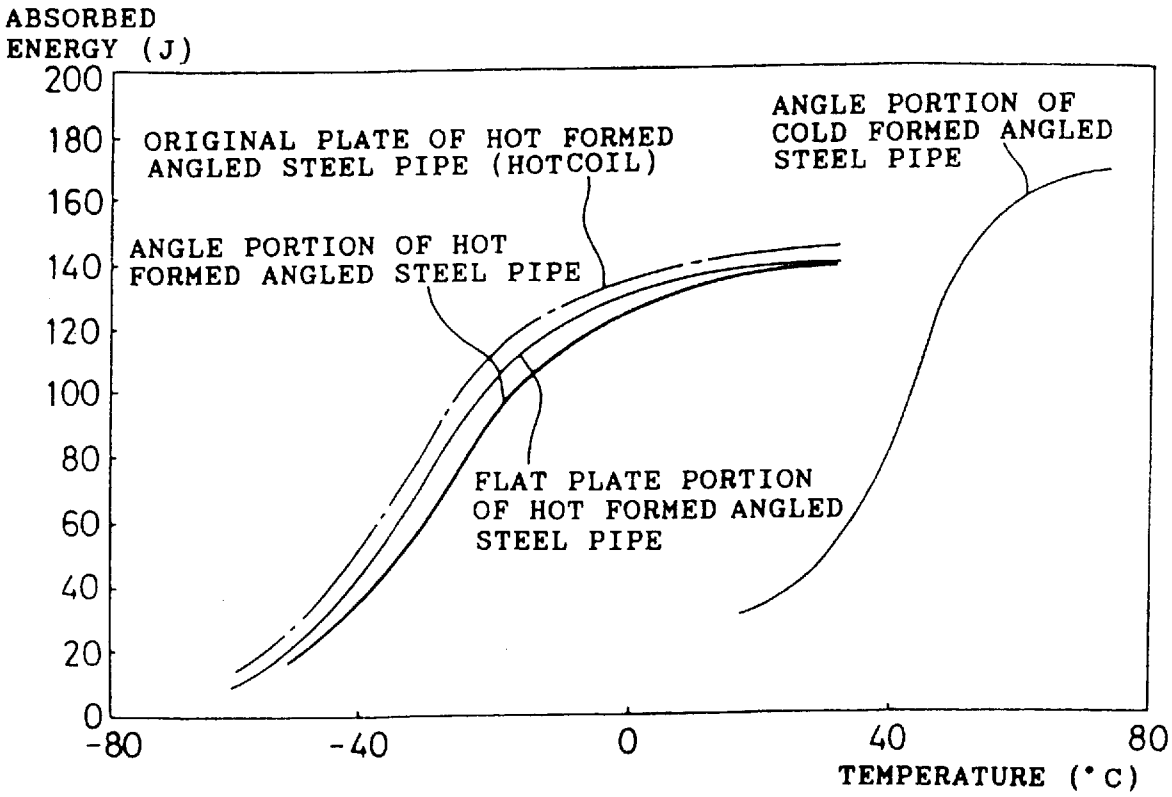
FIG. 17 shows transition curves for comparing the angled steel pipe manufactured by the method according to the present invention with the conventional angled steel pipe.

Though the polygonal hollow steel pipe 58, 58A, 85 is heated while being carried in the hot oven 12 in the longitudinal direction in each of the embodiments described above, it is possible, as in the seventh embodiment illustrated in FIGS. 12 and 13, to heat the pipe while carrying it laterally, or perpendicularly to the longitudinal direction.

When a large square angled steel pipe is to be manufactured, a square steel pipe (or a rectangular steel pipe) 1B which has a predetermined diameter, a plate thickness and a length matched with the angled steel pipe is prepared as an original pipe on an inlet bed 120 as shown in FIG. 12. The inlet bed 120 is a conveyor disposed on a floor 121, mounts a plurality of square steel pipes 1B in parallel with each other and carries them in a lateral direction B which is perpendicular to the longitudinal direction A. After carried to a terminal end of the inlet bed 120, the square steel pipes are carried into a hot oven 130 and heated to a high temperature H higher than the transformation point $A_3$ in the hot oven 130 while being carried in the lateral direction B perpendicular to the longitudinal direction A.

The hot oven 130 has a box-like form which is composed of an oven bottom wall 131 having a top surface serving as a supporting surface 131*a,* oven side walls 132 rising from both right and left ends of the oven bottom wall 131, an oven front wall 133 rising from a front end of the oven bottom wall 131, an oven rear wall 134 rising from a rear end of the oven bottom wall 131, and an oven ceiling wall 135 disposed among top ends of the oven rear wall 134, oven side wall 132, oven front wall 133 and oven rear wall 134. The hot oven 130 is supported on the floor 121 with a supporting frame 122 and so on.

Formed in the oven front wall 133 and the oven rear wall 134 are an inlet port 13 6 and an outlet port 137 respectively which are equipped with doors 138 and 139. The inlet port 136 and the outlet port 137 are formed so as to have a minimum size sufficient to allow the square steel pipes 1B which are to be heated and have a maximum diameter and a maximum length to pass therethrough with the pipes kept in the lateral direction B perpendicular to the horizontal direction A. A predetermined number of heating burners 140 are disposed at predetermined locations on oven walls 132 through 135. Further, a vertical smoke exhaust port is disposed in the oven ceiling wall 135 at a location in the vicinity of the outlet port 137.

Disposed on the oven bottom wall 131 are movable oven bodies 142 which are movable upward, downward, forward and backward. Speaking concretely, slits 143 having widths in the right-left direction are formed nearly over the entire back-and-forth direction at a plurality of locations in the right-left direction of the oven bottom wall 131 (four locations in the tenth embodiment) and the movable oven bodies 142 are fitted into these slits 143 so that they are freely movable upward, downward, forward and backward. Formed on a top surface of the movable oven body 142 are lifting surfaces 142*a* at a pitch corresponding to the predetermined pitch to be described later.

Disposed on the supporting surface 131*a* of the oven bottom wall 131 are rotating protrusion bodies 144 at predetermined single or plural locations. These rotating protrusion bodies 144 receive, preferentially to the supporting surface 131*a,* the square steel pipe 1B which is lowered (to be described later) and allow it to automatically rotate by half a turn (turn by itself), these rotating protrusion bodies 144 having inclined surfaces having higher priority on the side of the front end of the hot oven 130 and lower priority on the side of the rear end of the hot oven 130. The hot oven 130 is composed of the members 131 through 144 described above.

An inlet means 145 is disposed outside the inlet port 136 and an outlet means 146 is disposed outside the outlet port 137. These means 145 and 146 are of a clamp type or a lift type and may be omitted by utilizing conveying power of the inlet bed 120.

After led into the hot oven 130, the square steel pipe 1B is heated to a high temperature H while being carried intermittently in the lateral direction B perpendicular to the longitudinal direction A and backward by an intermittent sequential feeder 150 which moves the movable oven body 142 upward, downward, forward and backward. A concavity 123 is formed in the floor 121 located under the oven bottom wall 131 and base frames 151 are disposed on the bottom of the concavity 123. A plurality of supporting levers 152 are studded on the based frames 151 for supporting the bottom side of the oven bottom wall 131.

A movable body 153 is disposed so as to move upward, downward, forward and backward while avoiding the supporting levers 152. This movable body 153 is composed of a lower frame body 154, supporting levers 155 rising from a plurality of front and rear locations at a plurality of locations (four locations in the tenth embodiment) in the right-left direction of the lower frame body 154 and supporting plates 156 disposed between top ends of the front and rear supporting levers 155 at each location. The movable oven bodies 142 are fixed to the top surfaces of the supporting plates 156.

A lift 157 which is adopted for moving the movable body 153 is composed of a plurality of levers 159 which are disposed on the base frame 151 so as to freely swing by way of lateral pins 158, a back-and-forth reciprocating rod 160 which is connected between lower ends of the levers 159, a cylinder 161 for up-down motion which is connected to one end of the reciprocating rod 160 and rollers 162 which are hinged to top ends of the levers 159 and in contact with a bottom surface of the lower frame body 154 of the movable body 153. The lift 157 is disposed in a pair of a right lift and a left lift, and the cylinder 161 for up-down motion is operated in a pair in synchronization with each other.

A cylinder 163 for moving the movable body 153 forward and backward is disposed between an arm 164 connected forward from the lower frame body 154 and base frame 151. This cylinder 163 for back-and-forth motion as well as the cylinders 161 for up-down motion is connected so as to freely swing relative to the corresponding connecting member. The intermittent sequential feeder 150 is composed of the members 151 through 164 described above. Gaps which are variably formed in the slits 143 by the motion of the movable body 142 are adequately sealed with sealing members (not shown).

After the square steel pipe 1B has been carried to the terminal end of the inlet bed 120, the door 138 is opened, and the square steel pipe 1B is carried by the inlet means 145 in the lateral direction B perpendicular to the longitudinal direction A and led into the hot oven 130 through the inlet port 136. At this time, the movable oven body 142 is lowered and moved forward, or toward the inlet port 136. Accordingly, the square steel pipe 1B which has been led into the hot oven 130 is supported on the supporting surface 131*a* of the oven bottom wall 131 as shown in FIG. 13 and the door 138 is closed after the square steel pipe 1B has been led into the hot oven 130.

In this condition, a group of levers 159 swing due to contraction of the cylinders 161 for up-down motion and the movable body 153 is lifted tip by a group of rollers 162 which move upward, whereby a group of the movable oven bodies 142 are lifted as indicated by an arrow D in the slits 143 by the movable body 153 and the square steel pipe 1B which has been supported by the supporting surface 131*a* can be lifted by the lifting surfaces 142*a*. Then, the movable body 153 which is supported by a group of rollers 162 is retreated due to elongation of the cylinder 163 for back-and-forth motion and the movable body 153 retreats the group of the movable oven bodies 142 in the slits 143 as indicated by an arrow E shown in FIG. 12, thereby the square steel pipe 1B which is supported by the lifting surface 142*a* is retreated by a predetermined pitch.

Then, the group of the levers 159 swing due to elongation of the cylinders 161 for up-down motion and the movable body 153 is lowered by the group of the rollers 162 swinging downward, whereby the group of the movable oven bodies 142 are lowered in the slits 143 as indicated by an arrow F by the movable body 153 and the square steel pipe 1B which has been supported on the lifting surface 142*a* is delivered to the supporting surface 131*a*. Subsequently, the movable body 153 supported by the group of the rollers 162 is moved forward due to contraction of the cylinder 163 for back-and-forth motion, whereby the group of the movable oven bodies 142 are moved forward in the slits 143 as indicated by an arrow G by the movable body 153 and the lifting surface 142*a* is returned toward the front side by a predetermined pitch as indicated by an arrow G shown in FIG. 12.

In this condition, the square steel pipe 1B can be carried into the hot oven 130 through the inlet port 136 which is open for a short time. In the hot oven 130, the square steel pipe 1B can be carried from the front end side to the rear end side intermittently at a predetermined pitch in the lateral direction B perpendicular to the longitudinal direction A by operating the intermittent sequential feeder 150 by way of the movable oven bodies 142 almost free from thermal influences. During carriage in the hot oven 130, the square steel pipe 1B is heated with a flame projected from the burner 140 to a high temperature H exceeding the transformation point $A_3$.

A plurality of the square steel pipes 1B can be carried simultaneously and sequentially in the hot oven 130. Since the square steel pipes 1B are sequentially carried basically in a condition where they are kept stationary, the heating carriage can be performed without flowing the square steel pipes 1B. Further, the square steel pipes 1B are lowered as indicated by the arrow F shown in FIG. 12 at the predetermined locations, brought into contact with the inclined surfaces of the rotating protrusion bodies 144, rotated on the inclined surfaces so as to make a half turn, and received by the supporting surface 131*a*. Accordingly, the square steel pipes 1B make a single or a plurality of turns during the heating so as to change surfaces to be supported, thereby being heated uniformly.

The square steel pipes 1B which have been heated as described above and carried near the outlet port 137 are carried out by the operation of an outlet means 146 in the lateral direction B perpendicular to the longitudinal direction A through the outlet port 137 which is opened for a short time in synchronization with the downward motion F described above, or taken out of the hot oven 130 onto the conveyor 165. After the square steel pipes 1B are taken out, the door 139 is closed.

The seventh embodiment described above, in which the inlet port 136 and the outlet port 137 can be opened for a short time for carrying the square steel pipes 1B into the front end of the hot oven 130 and carrying the pipes 1B out of the rear end of the hot oven, are capable of reducing portions of flames flowing from the heating burner 140 into the inlet port 136 and the outlet port 137, thereby enhancing thermal efficiencies. Further, as the movable oven bodies 142 are moved upward, downward, forward and backward by the intermittent sequential feeder 150, it is possible to feed the square steel pipes 1B in a hot oven 130 intermittently at a predetermined pitch and sequentially from the front end side to the rear end side by way of the movable oven bodies 142 which are almost free from thermal influences. The square steel pipes 1B can be carried basically in stationary conditions thereof or free from injuries to be caused by carriage, and even such square steel pipes 1B that are large and heavy can be carried always stably without injuring the intermittent sequential feeder 150.

What is claimed is:

1. A manufacturing method for angled steel pipes, comprising the steps of:

press forming flat plate material into the shape of a polygonal hollow steel pipe by a pressing machine;

seam welding a pair of bevels of the polygonal hollow steel pipe to form the polygonal hollow steel pipe to a larger width size than that of the final product;

heating an entire portion of the seam-welded polygonal hollow steel pipe in a hot oven; and then hot forming the polygonal hollow steel pipe into an angled steel pipe while drawing the polygonal steel pipe to reduce the width size thereof by an angled steel pipe forming mill.

2. A manufacturing method for angled steel pipes according to claim 1, wherein the polygonal hollow steel pipe is formed so as to have a larger width size and a larger radius of curvature on angle portions thereof than those of the final product, then heating the entire polygonal hollow steel pipe in the hot oven, and hot forming the polygonal hollow steel pipe into the angled steel pipe while drawing the same to reduce the width size and the radius of curvature on angle portions of the polygonal hollow steel pipe by the angled steel pipe forming mill.

3. A manufacturing method for angled steel pipes, comprising steps of:

cold forming a circular original pipe by an angled steel pipe forming mill into a polygonal hollow steel pipe so as to have a larger width size than that of the final product;

heating an entire portion of the polygonal hollow steel pipe in a hot oven; and then hot forming the polygonal hollow steel pipe into an angled steel pipe while drawing the polygonal hollow steel pipe to reduce the width size thereof by another angled steel pipe forming mill.

4. A manufacturing method for angled steel pipes according to claim 3, wherein the polygonal hollow steel pipe is formed so as to have a larger width size and a larger radius of curvature on angle portions than those of the final product, then heating the entire portion of the polygonal hollow steel pipe in the hot oven, and hot forming the polygonal hollow steel pipe into the angled steel pipe while drawing the same to reduce the width size and the radius of curvature on angle portions of the polygonal hollow steel pipe by the other angled steel pipe forming mill.

* * * * *